United States Patent [19]

Nilsson et al.

[11] Patent Number: 4,779,574

[45] Date of Patent: Oct. 25, 1988

[54] POWER PLANT WITH COMBUSTION IN A FLUIDIZED BED

[75] Inventors: Karl-Johan Nilsson; Krishna Pillai, both of Finspong, Sweden

[73] Assignee: ASEA AB, Vasteras, Sweden

[21] Appl. No.: 113,300

[22] Filed: Oct. 28, 1987

[30] Foreign Application Priority Data

Oct. 29, 1986 [SE] Sweden ..... 8604603

[51] Int. Cl.[4] ..... F23B 33/00

[52] U.S. Cl. ..... 122/1 R; 60/655; 122/4 D

[58] Field of Search ..... 122/1 R, 4 D; 165/104.16; 60/655

[56] References Cited

U.S. PATENT DOCUMENTS

| | | | |
|---|---|---|---|
| 3,863,606 | 2/1975 | Bryers et al. | 122/4 D |
| 4,116,005 | 9/1978 | Willyong | 122/4 D |
| 4,449,483 | 5/1984 | Strohmeyer | 122/4 D |
| 4,476,816 | 10/1984 | Cannon et al. | 122/4 D |
| 4,655,147 | 4/1987 | Brannstrom et al. | 122/4 D |
| 4,665,864 | 5/1987 | Seshamani et al. | 122/4 D |

FOREIGN PATENT DOCUMENTS 784595 10/1957 United Kingdom .

*Primary Examiner*—Edward G. Favors

*Attorney, Agent, or Firm*—Pollock, Vande Sande & Priddy

[57] ABSTRACT

The invention relates to a power plant for combustion of a fuel, for example carbon, in a combustion chamber (2) in a bed (10) of fluidized particulate material, primarily a PFBC power plant. The plant includes a multistage steam turbine (13) and an intermediate superheater (12) for superheating steam between the turbine stages. The combustion chamber (2) is divided into a first and a second part (2*a*, 2*b*) by a wall (4) having one or more openings (42, 43) which takes up a minor part of the cross-section in the bed region and makes possible a limited exchange of bed material. The first part (2*a*) includes a nest of boiler tubes (11) for generating steam. The second combustion chamber part (2*b*) includes a nest of boiler tubes (12) for intermediate superheating of steam between the turbine stages. The combustion chamber parts (2*a*, 2*b*) are each connected to a fuel supply system (20, 21, 22 and 23, 24, 25, respectively). The control of the superheating takes place by control means (62) which control the bed temperature in the second combustion chamber part (2*b*) by controlling the fuel supply to said combustion chamber part (2*b*).

9 Claims, 3 Drawing Sheets

1
2
3
5
6
7
10
11a
13a
13b
14
15
17
22
26
27
28
32
33
34
34a
34b
35
36
37
38
40
G
G 2
2a
2b
4
5
6
7
8
10
11a
11b
12
12a
13
13a
13b
14
15
16
17
18
19
20
21
22
23
24
25
30
31
32
33
42
50
51
52
60
61
62
63
A
A
G
M
P

POWER PLANT WITH COMBUSTION IN A FLUIDIZED BED

TECHNICAL FIELD

The present invention relates to a power plant with combustion of a fuel in a fluidized bed of particulate material, especially a PFBC power plant, having nests of boiler tubes for both generation of steam and intermediate superheating of steam between turbine stages in the same bed vessel.

The term "PFBC" are formed by the initial letters in the English expression Pressurized Fluidized Bed Combustion.

BACKGROUND OF THE INVENTION

For power plants of the kind referred to here, no well-tried technique exists for superheating of steam between two turbine stages or between a high pressure turbine and a low pressure turbine. A choice between two principles is possible:

1. A separate nest of boiler tubes for intermediate superheating of steam is located in the common bed vessel. This embodiment gives insufficient possibilities of obtaining optimum steam data. The superheating tube nest can be dimensioned so as to obtain optimum steam data at full load. The tubes in the tube nest can be distributed in horizontal layers in such a way that the tube area above the bed and in the bed, respectively, is of such a magnitude as to obtain as suitable a superheating as possible at partial load. However, the dimensioning and the distribution of the tubes make it impossible to obtain optimum intermediate superheating of the steam. This applies particularly to the case of partial load. Maladjustment between steam flow and tube area means that it is necessary either to inject water to prevent an impermissible increase in temperature in the tube nest, or that it must be accepted that no optimum superheating is obtained. In both cases, the efficiency of the power plant is reduced.

2. A tube nest for intermediate superheating of steam is located in a separate bed vessel. This embodiment makes it possible in the desired way separately to control the intermediate superheating and obtain optimum steam data for different turbine stages under all operating conditions. The plant is complicated by the fact that each one of the beds has to be provided with complete control systems for an air supply, fuel supply and bed depth control, for example a doubling of the control systems.

SUMMARY OF THE INVENTION

According to the present invention, the combustion chamber of a power plant is constructed with a partition wall which divides the combustion chamber into a first part and a second part. The partition has at least one opening through which the two combustion chamber parts communicate and through which a limited exchange of bed material takes place. In the first combustion chamber part there is a first tube nest for generating and superheating steam for a high pressure turbine or a first turbine stage, and in the second combustion chamber part there is a second tube nest, separated from the first tube nest, for intermediate superheating of the steam supplied to a low pressure turbine or a second turbine stage. In addition to the normal measuring and control devices for power, bed depth, bed temperature and air quantity, etc., the plant is provided with a temperature sensor which senses the temperature of the intermediately superheated steam, a temperature sensor which senses the temperature in the second combustion chamber part, and a signal processing and control equipment which receives output signals from these sensors and controls the fuel supply to a separate fuel supply system for the second combustion chamber part. The temperature of the intermediately superheated steam is controlled by controlling the temperature of the bed between a highest and a lowest value by adjusting the fuel supply.

By dividing the combustion chamber into two parts by means of a wall with one or more openings, which enables a limited exchange of bed material and which supplies the combustion chamber parts with separately controlled fuel supply systems, different bed temperatures can be achieved in the two combustion chamber parts when the same bed depth and the same specific air flow prevail. For controlling the temperature of the intermediately superheated steam, only an additional, separate fuel supply system and a separate control system therefor are required. Sufficient possibilities of controlling the intermediate superheating of steam can be obtained in a simple way at only a slightly increased investment and operating cost.

BRIEF DESCRIPTION OF THE DRAWING

The present invention will be described in more detail with reference to the accompanying schematic drawing, wherein.

DETAILED DESCRIPTION OF THE PREFERRED EMBODIMENT

Figure 1:
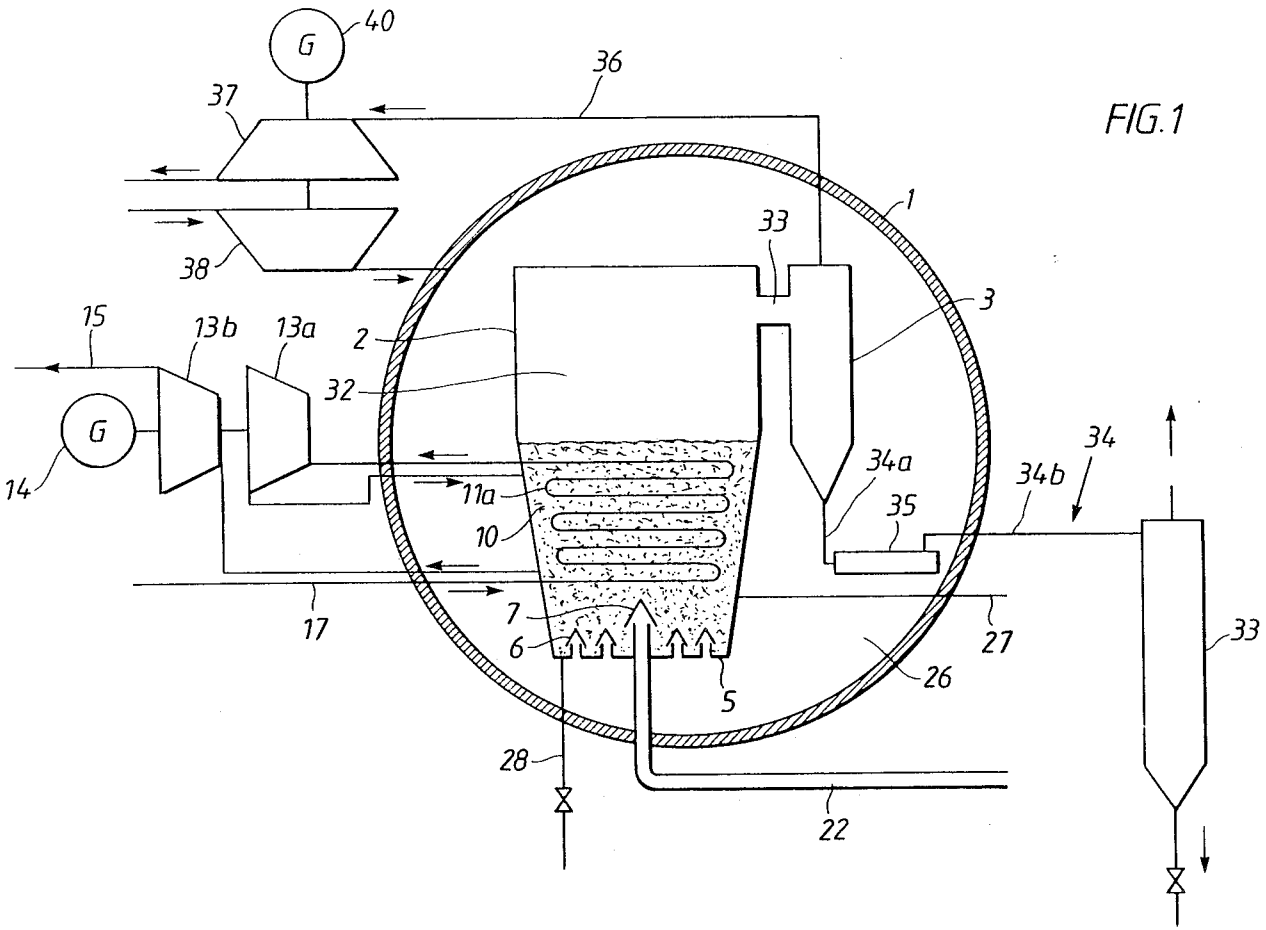
FIG. 1 shows the present invention as applied to a PFBC power plant with a combustion chamber and a cleaning equipment enclosed within a pressure vessel.
Figure 2:
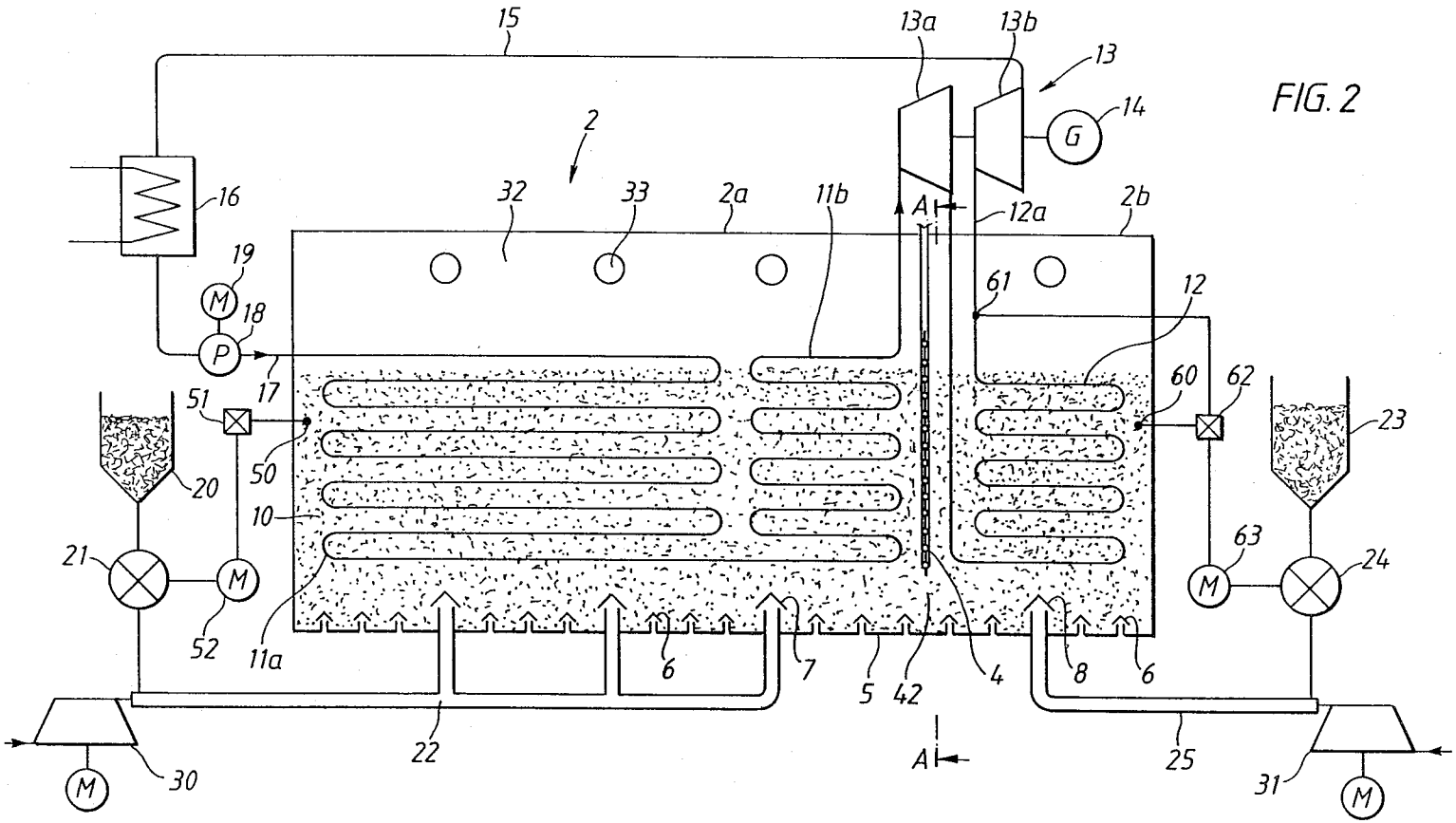
FIG. 2 shows a longitudinal section through a combustion chamber.

In the drawing, numeral 1 designates a pressure vessel, which includes a combustion chamber 2 and a gas cleaning plant symbolized by a cyclone 3. The combustion chamber 2, as shown in the longitudinal section in FIG. 2, is divided by a partition 4 into two parts 2*a* and 2*b*. The combustion chamber 2 is provided with a bottom 5 with air nozzles 6 and with fuel nozzles 7 in part 2*a* and fuel nozzles 8 in part 2*b*. The combustion chamber 2 accomodates a bed 10 of particulate material containing or consisting of a sulphur absorbent such as lime or dolomite. As shown in FIG. 2, the first combustion chamber part 2*a* contains a nest of tubes which is divided into a first tube nest 11*a* and a second tube nest 11*b* for respectively generating and superheating steam to a turbine 13 which drives a generator 14. The turbine 13 contains a high pressure part 13*a*, which is supplied with superheated steam from the superheater tube nest 11*b*, and a low pressure part 13*b*, which is supplied with steam which has passed through the high pressure part 13*a* of the turbine 13 and has been superheated in the intermediate superheater 12. Steam leaving the low pressure part 13*b* of the turbine 13 is passed in the conduit 15 to the condenser 16. Condensate is returned to the tube nest 11*a* through the conduit 17 with the feed water pump 18 which is driven by the motor 19. Fuel is supplied to the combustion chamber part 2*a* from the fuel storage 20 through the rotary vane feeder 21, the conveying pipe 22 and the nozzles 7. Fuel is supplied to the combustion chamber part 2b from the fuel storage 23 through the rotary vane feeder 24, the conveying pipe 25 and the nozzles 8. Air for fluidization of the bed 10 and for combustion of supplied fuel is supplied to the combustion chamber 2 through the nozzles 6 in the bottom 5 thereof from the space 26 between the pressure vessel 1 and the combustion chamber 2 (FIG. 1). Bed material is supplied to the bed 10 through a conduit 27 and is removed through a conduit 28. Transport gas is compressed in the compressors 30 and 31, respectively.

The combustion gases are collected in the freeboard 32, which is common to both parts 2a, 2b of the combustion chamber 2, above the bed 10 and is passed through the conduit 33 to a cyclone 3, in which dust is separated from the gases. This separated dust is transported away through the conduit 34 to the collecting container 35. Between the conduit sections 34a and 34b there is a pressure reducing cooler 35 for the dust and its transport gas. The cleaned combustion gases are passed through the conduit 36 to the gas turbine 37 which drives the compressor 38 which compresses combustion air supplied to the space 26 in the pressure vessel 1. The turbine 37 also drives a generator 40. The gases leaving the turbine 37 are brought to a feed water preheater (not shown).

Figure 3:
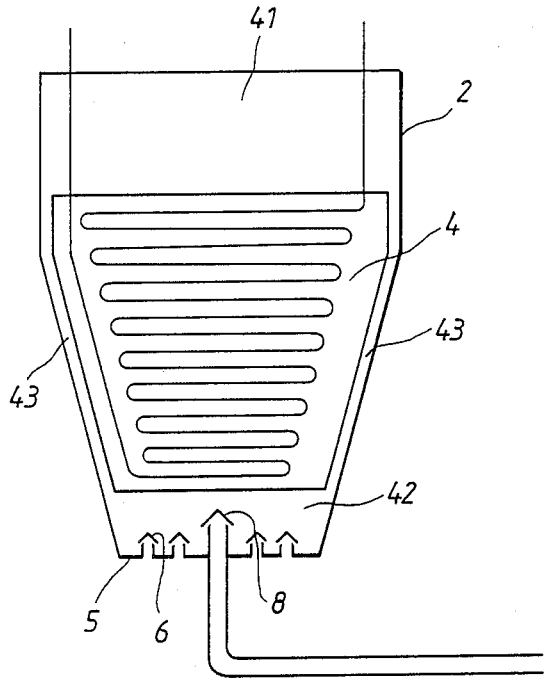
FIG. 3 shows a cross section through the combustion chamber along line A—A in FIG. 2.

As shown in FIG. 3, the partition wall 4 is water-cooled. It does not completely separate the combustion chamber parts 2a, 2b from each other. It has a height somewhat exceeding the highest bed depth. A free connection is provided between the parts 2a, 2b in the freeboard 32 through the opening 41 above the partition 4. Further, in the shown embodiment there are an opening 42 between the bottom 5 and the partition 4 and gaps 43 between the partition 4 and the side walls 44 of the combustion chamber 2. The total area of the opening 42 and the gaps 43 is chosen such that sufficient material exchange can take place between the parts 2a and 2b so that the same bed level is obtained while at the same time the exchange between the parts 2a, 2b is so low that different temperature levels can be maintained. Through the opening 42 and the gaps 43, the combustion chamber parts 2a, 2b act as communicating vessels in the bed region. The bed level is therefore the same in both combustion chamber parts 2a, 2b. In the case of uniform operation, a very limited transfer of bed material is obtained between the parts 2a and 2b. Therefore, it will be possible, to a certain extent and in a simple manner, to control the temperature in the bed in the second combustion chamber part 2b such that the temperature deviates from the temperature in the first combustion chamber part 2a only by controlling the fuel supply, thus controlling the superheating of the steam from the high pressure turbine 13a which is intermediately superheated in the tube nest 12 before being supplied to the low pressure turbine 13b. Because the parts 2a and 2b communicate with each other and because a fluidized bed 10 appears as a liquid, the level of the entire bed can be changed with one single bed controlling system. By injecting gas through suitably horizontally orientated nozzles close to the openings 42, 43, the material exchange between the parts 2a and 2b can be increased, for example to rapidly reduce the temperature difference.

The appropriate bed temperature is to a certain extent dependent on the fuel and its tendency to form major slag lumps. A bed temperature of about 850° C. is usually suitable and there may be possibilities of operating the bed within the range of 750°–900° C. If the temperature drops to below a certain temperature, combustion cannot be maintained. If the temperature rises to above a certain level, the formation of slag may render continued operation impossible. For controlling the superheating, the possibility of raising the temperature in the bed in the second combustion chamber part 2b by 25° C. above or lowering it by 50° C. below the temperature in the bed in the first combustion chamber part 2a is fully sufficient.

The first combustion chamber part 2a includes a temperature sensor 50. This is connected to a signal processing and control equipment 51 which receives the output signal of the sensor 50 and compares the actual value with a desired value and, in dependence thereon, controls the speed of a motor 52 which drives the rotary feeder 21 which determines the fuel supply to the combustion chamber part 2a. Further there are measuring means (not shown) for measuring the bed depth, the air excess, and so on, as well as signal processing and operating means for controlling the bed depth and the air supply in dependence on the power requirement.

The second combustion chamber part 2b includes a temperature sensor 60. In the conduit 12a emanating from the tube nest 12, there is a temperature sensor 61 which measures the temperature of the outgoing steam. These two sensors 60, 61 are connected to a signal processing and control equipment 62 which compares supplied actual values with desired values and controls the speed of a motor 63 which drives the rotary feeder 24 which controls the fuel supply to the combustion chamber part 2b. By the control equipment 62, the fuel supply to the combustion chamber part 2b is controlled so as to maintain such a temperature in the bed, as to obtain the desired steam temperature. The control possibility is limited by the maximum and minimum permissible temperatures in the bed with respect to the risk of slag formation and to the possibility of maintaining the combustion. With a suitable dimensioning of the tube nest 12, a sufficient control of the steam temperature can be obtained within the permissible temperature variation within the bed.

We claim:

1. A power plant for combustion of a fuel, primarily carbon, in a bed of particulate material in a fluidized state inside a combustion chamber, wherein:

the combustion chamber contains a vertical partition wall which divides said combustion chamber in the bed region into a first and second part, a common freeboard above said first and second parts of said combustion chamber for collecting combustion gases generated in the bed in said first and second parts, at least one opening is provided in said partition wall through which said first and second parts of said combustion chamber communicate and through which a limited exchange of bed material takes place, in said first combustion chamber part there is a first tube nest for generating steam, and in said second combustion chamber part there is a second tube nest for superheating of steam.

2. Power plant according to claim 1, wherein the power plant includes a steam turbine with a high pressure part and a low pressure part and said second tube nest is connected between said high pressure part and said low pressure part of said turbine and forms an intermediate superheater.

3. Power plant according to claim 1, wherein the plant comprises a first fuel supply system which supplies said first combustion chamber part with fuel, and a second fuel supply system which supplies said second combustion chamber part with fuel.

4. Power plant according to claim 3, wherein the plant includes a temperature measuring means which measures the temperatures of the steam superheated in said second tube nest, and a temperature measuring means which measures the temperature in the bed in said second combustion chamber part, and a signal processing and control equipment which receives output signals from said measuring means, compares the actual value of the steam temperature with a given desired value and the actual value of the bed temperature with permissible maximum and minimum values of the bed temperature and in dependence on deviations from given desired values, delivers a control signal to a supply unit for supplying fuel to said second combustion chamber part.

5. Power plant according to claim 1, wherein the combustion chamber is enclosed within a pressure vessel and surrounded by compressed combustion air.

6. Power plant according to claim 2, wherein the power plant comprises a first fuel supply system which supplies said first combustion chamber part with fuel, and a second fuel supply system which supplies said second combustion chamber part with fuel.

7. Power plant according to claim 2, wherein the combustion chamber is enclosed within a pressure vessel and surrounded by compressed combustion air.

8. Power plant according to claim 3, wherein the combustion chamber is enclosed within a pressure vessel and surrounded by compressed combustion air.

9. Power plant according to claim 4, wherein the combustion chamber is enclosed within a pressure vessel and surrounded by a compressed combustion air.

* * * * *